US007404668B2

(12) United States Patent
Hiranuma et al.

(10) Patent No.: US 7,404,668 B2
(45) Date of Patent: Jul. 29, 2008

(54) TIMEPIECE

(75) Inventors: Haruki Hiranuma, Chiba (JP); Hideaki Koshoji, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/827,019

(22) Filed: Jul. 10, 2007

(65) Prior Publication Data

US 2008/0025157 A1 Jan. 31, 2008

(30) Foreign Application Priority Data

Jul. 26, 2006 (JP) ..... 2006-203192

(51) Int. Cl.
*G04B 37/00* (2006.01)
*G04B 39/00* (2006.01)
*G04B 29/00* (2006.01)

(52) U.S. Cl. ..... 368/294; 368/297; 368/300

(58) Field of Classification Search ..... 368/88, 368/281, 291, 292, 294, 295, 297–300, 309
See application file for complete search history.

(56) References Cited

U.S. PATENT DOCUMENTS 3,849,981 A * 11/1974 Tarusawa et al. ..... 368/291
3,910,031 A * 10/1975 Keida ..... 368/281
4,696,577 A * 9/1987 Muller et al. ..... 368/276
4,740,935 A * 4/1988 Gogniat ..... 368/294
5,490,123 A * 2/1996 Biver ..... 368/295
5,825,722 A * 10/1998 Meyrat et al. ..... 368/276
6,406,178 B1 * 6/2002 Luscher et al. ..... 368/286
2002/0080688 A1 6/2002 Hiranuma et al.
2002/0131332 A1 * 9/2002 Kaelin et al. ..... 368/281

FOREIGN PATENT DOCUMENTS

JP 2002-189084 7/2002

* cited by examiner

*Primary Examiner*—Vit W Miska
(74) *Attorney, Agent, or Firm*—Adams & Wilks

(57) ABSTRACT

To provide a timepiece in which it is possible to promote an edge thinning of an edge member without impairing an exchangeability of a gasket between the edge member to which a glass has been fixed and a case band, and a selectivity of a fixation means of the glass to the edge member. In a case band of an armor case in which a timepiece movement with a dial has been built in, there is provided an inner periphery convex part forming a fit hole while protruding to a case band inside. In an annular edge member which is overlapped to a front side of the case band and to which a glass has been fixed, there are provided a tubular fit part fitted to a fit hole, and a dial cover site covering a peripheral part surface of the dial. An annular seal gasket made of an elastic material is nipped, in an outside than the fit hole, between the edge member and the case band. Plural threaded holes are formed over the inner periphery convex part and the fit part, and there is made such that one part of each of the respective threaded holes is included in a projected region of the seal gasket to a back side. The edge member is retained to the case band by detachably screwing a threaded-axle-like connection member to each of the respective threaded holes from back sides of the inner periphery convex part and the fit part.

6 Claims, 7 Drawing Sheets

TIMEPIECE

BACKGROUND OF THE INVENTION

1. Field of the Invention

The present invention is concerned with a portable timepiece like a wristwatch for instance, or the like, and relates especially to a timepiece in which there has been improved a structure retaining an edge member, to which a glass has been attached, to a front side of a case band.

2. Description of the Prior Art

Hitherto, in order to make a width of an annular edge member to which the glass has been attaches, in other words, a dimension corresponding to a dimension difference between an inner diameter and an outer diameter of the edge member, small (This is refereed to as an edge thinning of the edge member.), there is known a technique in which a screw fixing a bezel to the case band by the fact that it is inserted into the case band accommodating a timepiece movement and screwed to the bezel (edge member) is disposed in an inside than a gasket having been provided between the case band and the bezel while ensuring a waterproofness between them (e.g., refer to JP-A-2002-189084 Gazette (paragraphs 0008-0010, 0013-0019, FIG. 1-FIG. 5)).

This prior art is shown in FIG. 7. In FIG. 7, a reference numeral 1 denotes an armor case of one-piece structure, in which a case band 1*a* and a case back part 1*b* have been monolithically formed, and a reference numeral 2 a timepiece movement having been accommodated in the armor case 1 while being retained in a casing ring 3, respectively. To the timepiece movement 2, there are attached a dial 4 and timepiece hands 5. In FIG. 7, a reference numeral 6 denotes a bezel to which a glass 7 has been fixed, a reference numeral 8 a gasket, and a reference numeral 9 a screw, respectively. Further, a reference numeral 6*a* in FIG. 7 denotes a female thread part monolithically formed in a back side of the bezel 6 and having been fitted to the case band 1*a* from its front face side, and the screw 9 is screwed to this female thread part 6*a* from the back side. Additionally, a reference numeral 6*b* in FIG. 7 denoted a dial cover site having been formed while forming an inner periphery part of the bezel 6.

In this prior art, since the case band 1*a* and the bezel 6 are connected by the screw 9 and the gasket 8 has been nipped between them, an exchange of the gasket 8 is suitable possible. Not only it, there is no fear that a glass fixation part 6*c* of the bezel 6 is deformed by a stress following upon a screwing of the screw 9. Therefore, a fixation of the glass 7 to the bezel 6 may be performed by using an adhesive, or it is also possible to fix the glass 7 by pushing-in it into an inside of an attachment ring having an interference due to an elastic deformation by disposing this ring in an inner periphery of the glass fixation part 6*c*, and it is desirable in a point that choices for fixing the glass 7 increase.

In the technique of the Patent Document 1, since it is a constitution in which the screw 9 is meshed with the female thread part 6*a* having been provided in the bezel 6, this female thread part 6*a* has a threaded hole 6*d*. In order to ensure this threaded hole 6*d*, it is necessary to form the threaded hole 6*d* by a site surrounding the threaded hole 6*d* while having a thickness thicker than a certain degree. Since the bezel 6 has the threaded hole 6*d* like this, the edge thinning of this bezel 6 is not sufficient, so that there is a room for an additional improvement.

Concretely, a width T1 of the bezel 6, which has been shown in FIG. 7, in other words, a dimension T1 from the dial cover site 6*b*, which specifies an inner diameter of the bezel 6 and a parting dimension E of the dial 4, to an outer diameter of the bezel 6, is denoted by a value in which dimensions A-D and Z along a radial direction of each site of the bezel 6 have been totaled.

The dimension A is a dimension of the dial cover site 6*b*, the dimension B a dimension of a site from an inner periphery of the male thread part 6*a* to a center line of the threaded hole 6*d*, the dimension C a dimension of a site having contacted with the gasket 8, the dimension D a dimension of a site from an outer periphery of the gasket 8 to an outer periphery of the bezel 6, and the dimension Z is a dimension of a site from an inner periphery of the gasket 8 to the center line of the threaded hole 6*d* and, by this dimension Z, a disposition of the screw 9 is deviated to an inside of the gasket 8.

The width T1 of the bezel 6, which is formed by the total of the dimensions A-D and Z like these, is small in comparison with a constitution in which the screw 9 has been disposed in an outside of the gasket 8. However, since there is required the dimension Z for disposing the screw 9 in an inside of the gasket 8, it is not suitable for making the width T1 of the bezel 6 smaller to thereby perform the edge thinning.

SUMMARY OF THE INVENTION

An object of the present invention is to provide a timepiece in which it is possible to promote the edge thinning of the edge member without impairing an exchangeability of the gasket between the edge member to which the glass has been fixed and the case band, and a selectivity of a fixation means of the glass in regard to the edge member.

The present invention possesses an armor case which possesses a case band protruding to a case band inside and having an inner periphery convex part having formed a fit hole while continuing in a circumferential direction, and in which a timepiece movement with a dial has been built in, an annular edge member which is overlapped to a front side of the case band while having a tubular fit part having been fitted to the fit hole and a dial cover site having covered a peripheral part front face of the dial in a case band inside than the fit part, and to which a glass has been fixed, an annular seal gasket comprising an elastic material, which has been provided in an outside than the fit hole and nipped between the edge member and the case band, plural threaded holes which are formed over the inner periphery convex part and the fit part while being positioned in a back side of the gasket, and in which one part is included in a projected region of the seal gasket to the back side, and a threaded-axle-like connection member detachably screwed to each of the threaded holes from back sides of the inner periphery convex part and the fit part to thereby retain the edge member to the case band.

The present invention can be applied to a portable timepiece such as wristwatch and pocket watch, and a desk clock, a wall clock or the like. In the present invention, the armor case may be one having possessed the case band whose both faces in a thickness direction (front-back direction) have been opened, and a case back detachably attached to the case band while closing a back face opening of the case band, or one of one-piece structure in which the case band and case back are monolithically formed and only a facade side has been opened. In the present invention, the seal gasket is disposed between the case band and the edge member by forming a gasket accommodation groove in any one of the case band or the edge member and accommodating it in this groove. In the present invention, the back side of the seal gasket indicates a side in which the case back of the armor case is positioned with the seal gasket being made a reference, and the projected region of the seal gasket indicates a region in which the seal gasket is projected while seeing the timepiece from the facade side (front side).

In the present invention, since the case band and the edge member have been connected by screwing the threaded-axle-like connection member to the threaded hole having been provided over the inner periphery convex part of the case band and the fit part of the edge member from the back sides of the case band and the edge member, it is possible to provide the connection member in a disposition in which one part of the connection member is included in the projected region of the seal gasket to the back side. By this, following upon there becomes null the fact that all of the threaded holes are provided in the fit part, since it becomes unnecessary to ensure a dimension for disposing, in the edge member, the connection member while being deviated to an inside of the seal gasket, the edge thinning of the edge member can be promoted.

Further, as mentioned already, since the case band and the edge member have been connected from their back sides by the threaded-axle-like connection member, there is no fact that a stress following upon this connection extends to a portion in which a glass of the edge member is fixed. Therefore, it is possible to fix the glass to the edge member by utilizing a bonding fixation or the interference of an attachment ring, so that there is no fact that the selectivity of the fixation means of the glass in regard to the edge member is impaired. Additionally, since the connection member can be detached by being rotated in a direction removing its screwing, a maintenance for solely exchanging the seal gasket is possible.

In a desirable mode of the present invention, an inner periphery face of the seal gasket is provided so as to contact with an outer periphery face of the fit part, and a half threaded hole portion having been formed in the inner periphery convex part within the threaded hole is caused to be included in the projected region of the seal gasket to the back side.

In the mode of this invention, the edge thinning of the edge member can be promoted by a dimension corresponding just to dimensions of radii of the threaded hole and the connection member without bringing about a decrease in a function connecting and coupling the case band and the edge member.

Further, in a desirable mode of the present invention, a gasket accommodation groove opening over a front face of the case band, with which the edge member contacts, and an inner periphery face of the inner periphery convex part is formed in the case band, and the seal gasket is attached to the accommodation groove.

In the mode of this invention, since the gasket accommodation groove has been provided in the case band, the gasket accommodation groove can be worked more easily than a groove working in a case where the gasket accommodation groove is provided in a back face of the edge member. Together with this, there can be made such that the connection member does not loosen carelessly, by vanishing a mesh interstice between the threaded hole and the connection member by a pre-load due to an elastic repulsion force of the seal gasket following upon the fact that a distance between the seal gasket contacting with an outer periphery face of the fit part and the connection member becomes minimum.

Additionally, in a desirable mode of the present invention, a length of the fit part along a thickness direction of the timepiece is shorter than a length of the inner periphery convex part along the thickness direction of the timepiece, and a head part contacting with a back face of the inner periphery convex part is provided in the connection member.

In the mode of this invention, since the connection member has the head part corresponding to a screw head, following upon the fact that a tool engagement part with which a tool for rotation-operating the connection member engages can be made large, a rotation operation of the connection member becomes easy to perform. Together with this, it is possible to more strongly nip the seal gasket having been disposed between the edge member and the case band by bringing the edge member closer to the back side, following upon the fact that the case band and the edge member are connected by screwing the connection member so as to decrease or vanish a gap which is formed, at an assembly time, between the back face of the fit part and the head part of the connection member by a difference in length between the fit part and the inner periphery convex part along a thickness direction of the timepiece.

According to the present invention, since it is unnecessary to provide, in the fit part of the edge member, all of the threaded holes to which the threaded-axle-like connection member connecting the case band and the edge member is screwed, it is possible to promote the edge thinning of the edge member and the connection member can connect and detach the case band and the edge member, so that it is possible to provide a timepiece not impairing the exchangeability of the gasket between the edge member to which the glass has been fixed and the case band, and the selectivity of the fixation means of the glass in regard to the edge member.

DETAILED DESCRIPTION OF THE PREFERRED EMBODIMENTS

A first embodiment of the present invention is explained by referring to FIG. 1-FIG. 5.

Figure 1:
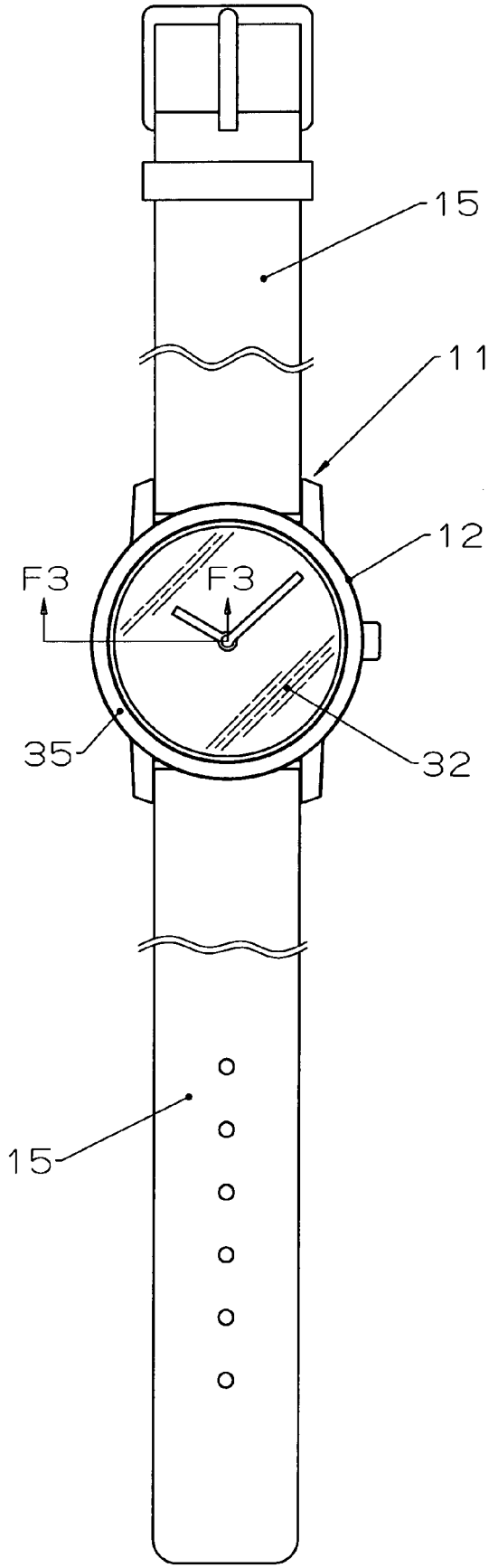
FIG. 1 is a plan view showing a wristwatch concerned with a first embodiment of the present invention.
Figure 3:
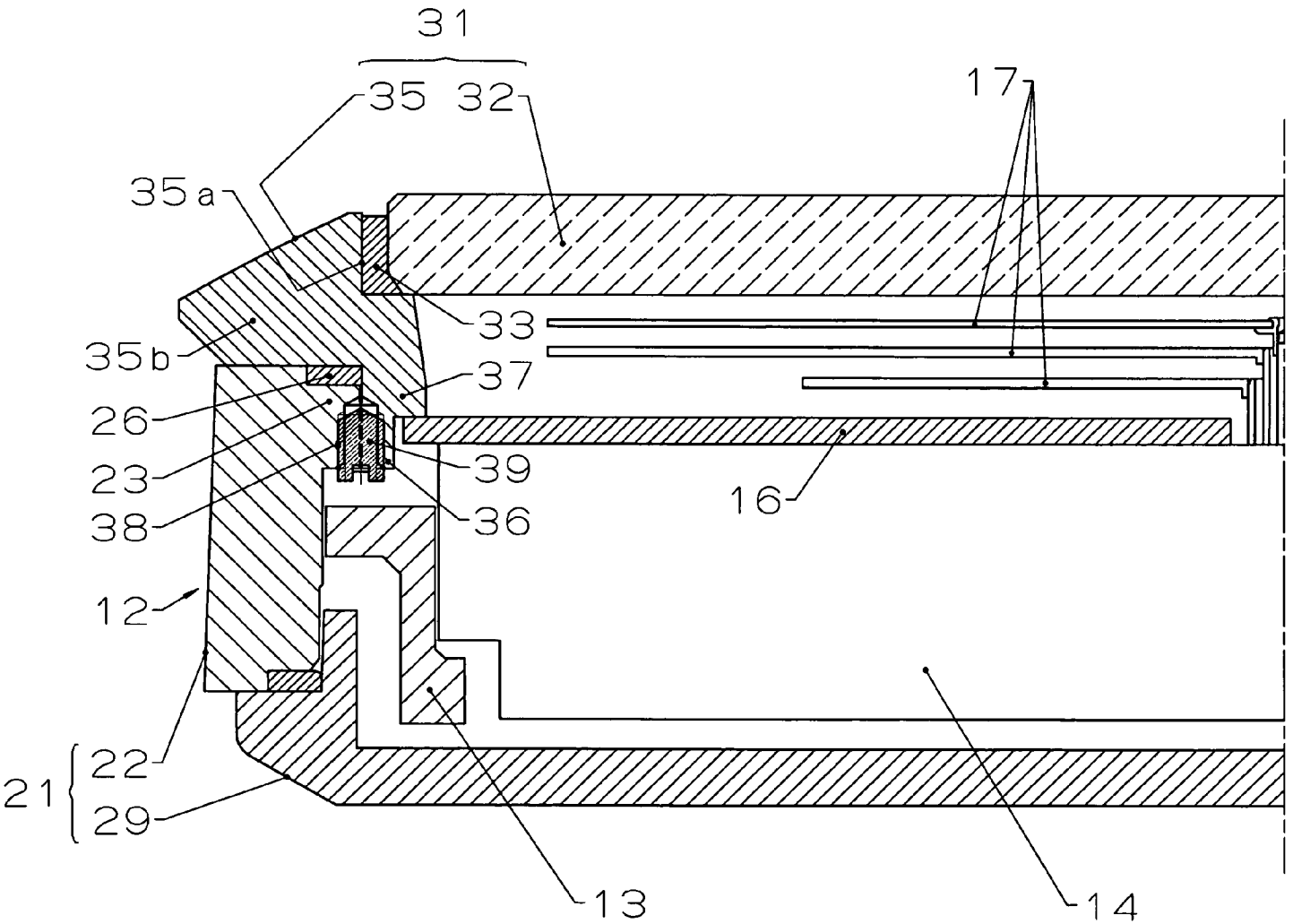
FIG. 3 is a sectional view showing along an F3-F3 line in FIG. 1.

A reference numeral 11 in FIG. 1 denotes a timepiece, e.g., wristwatch. This wristwatch 11 possesses a timepiece armor assembly 12 and, in this timepiece armor assembly 12, as shown in FIG. 3 there are built in a timepiece movement 14 and the like through a casing ring 13 that is a movement retention member. Incidentally, a reference numeral 15 in FIG. 1 denotes an attachment member such as timepiece band and, by this attachment member 15, the wristwatch 11 is attached to an arm of a human body.

As shown in FIG. 3, the timepiece movement 14 has a dial 16 and timepiece hands 17. The timepiece movement 14 may be any of one in which a small battery or a mainspring has been made a power, or self-winding one having an oscillating weight, or one corresponding to a digital timepiece digital-displaying a time instant and the like on the dial 16 by a quartz oscillation module, or one in which the one corresponding to the digital timepiece and one other than it have been jointly used, or the like.

Figure 4:
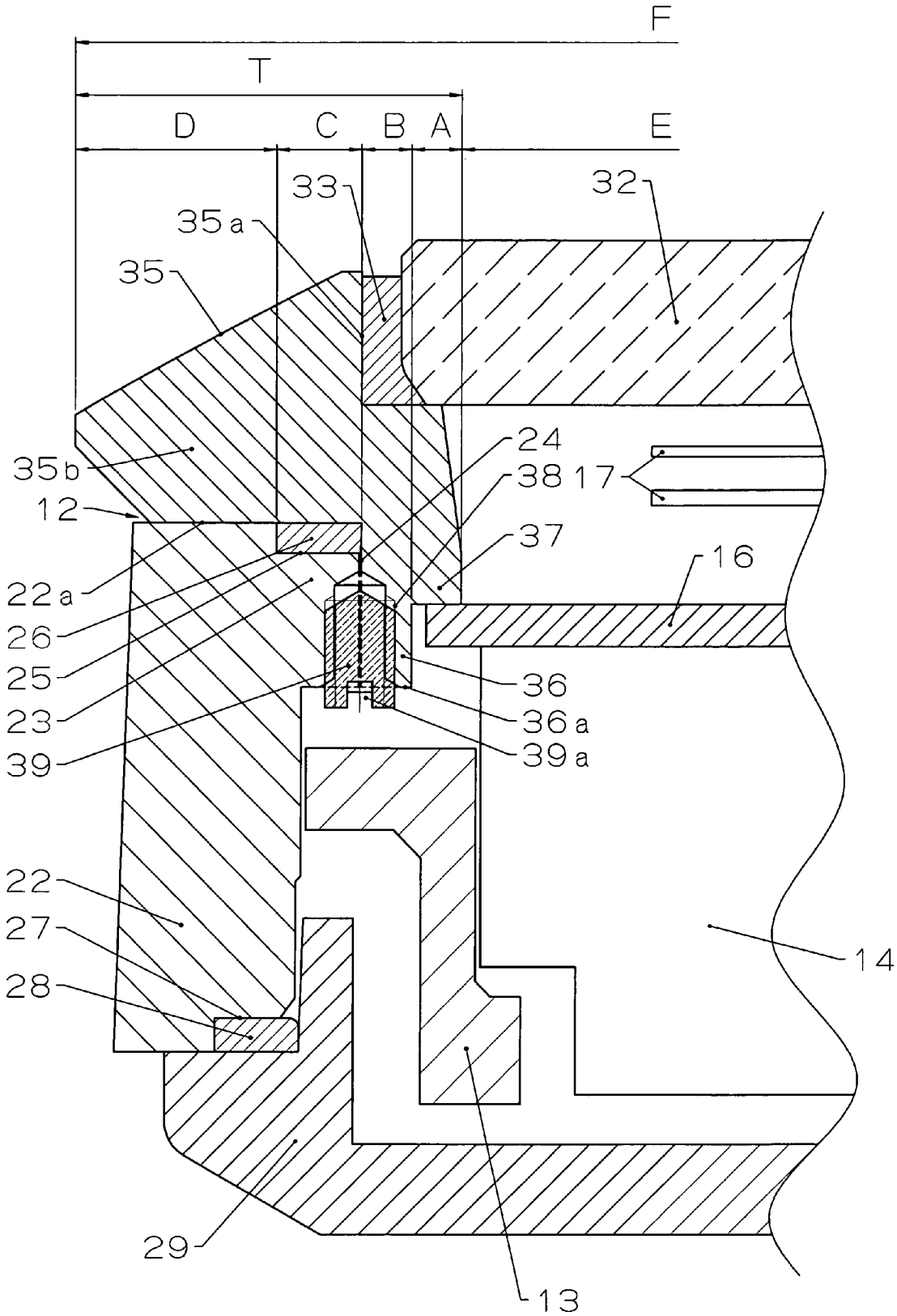
FIG. 4 is a sectional view showing one part of the wristwatch in FIG. 1.
Figure 5:
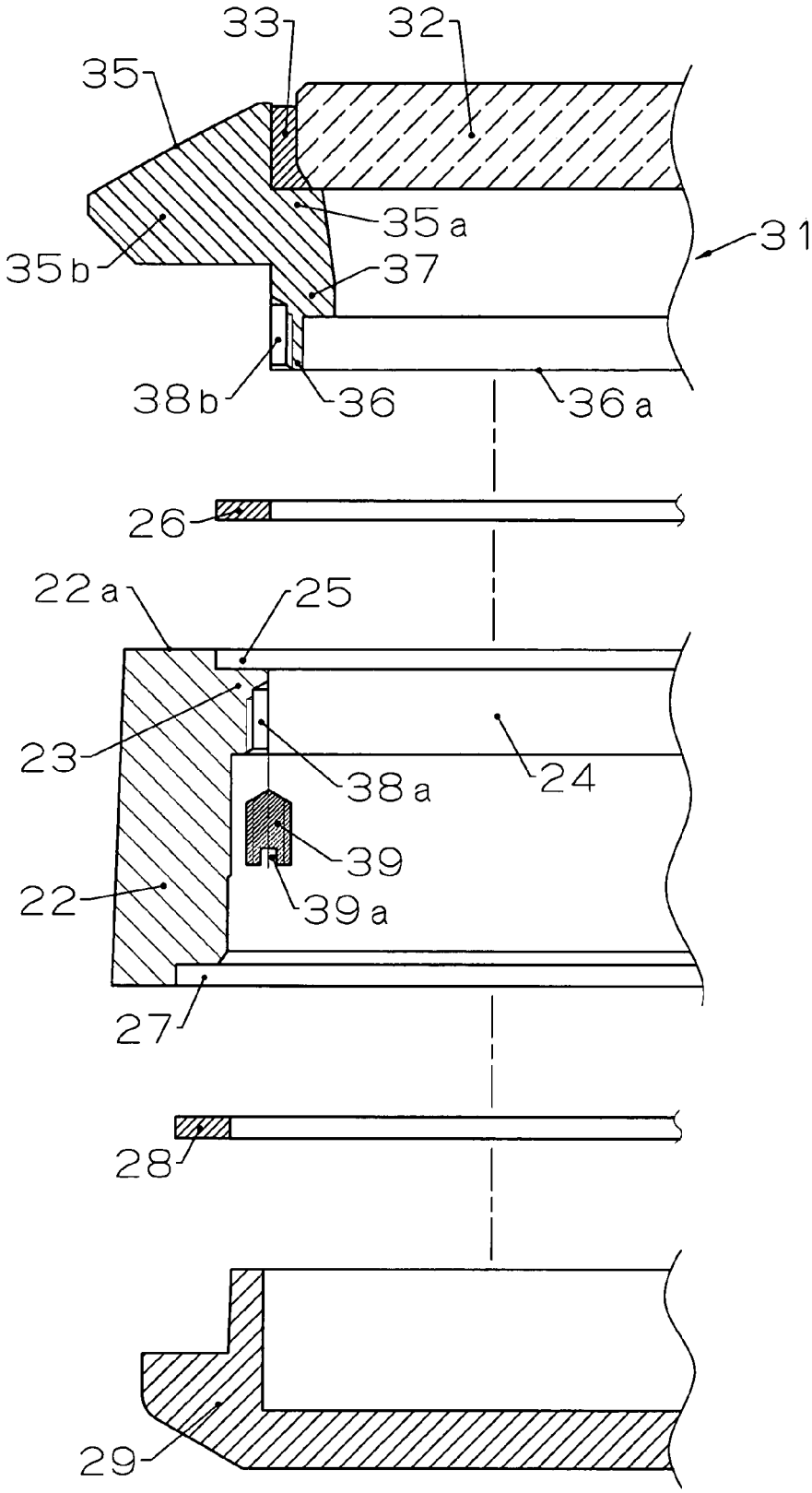
FIG. 5 is a sectional view showing one part shown in FIG. 4 while being disassembled.

As shown in FIG. 3-FIG. 5, the timepiece armor assembly 12 possesses an armor case 21 and an armor cover 31 having been mounted to the former.

The armor case 21 possesses a case band 22 desirably made of a metal, and a case back 29. The case band 22 is an annular shape for instance, and its both ends in a thickness direction are respectively opened. The case band 22 has in its side end part an inner periphery convex part 23 having been monolithically protruded to a case band inside. This inner periphery convex part 23 is annularly provided while continuing in a circumferential direction of the case band 22, and forms a fit hole 24 (refer to FIG. 5) while narrowing a front side opening of the case band 22. Here, the fact that the inner periphery convex part 23 is "annular" includes an annular shape, e.g., a polygonal, annular shape such as quadrangular, annular shape, or a shape in which they have been combined.

In a front side end part of the case band 22, there is formed an annular gasket accommodation groove 25 having continued in the circumferential direction. The gasket accommodation groove 25 is opened over a front face 22*a* of the case band 22 and an inner periphery face of the inner periphery convex part 23. An annular seal gasket 26 is accommodated in the gasket accommodation groove 25. The seal gasket 26 consists of a material capable of elastically deforming. A thickness of the seal gasket 26 in its free state is slightly thicker than a depth dimension of the gasket accommodation groove 25.

Also in a back side end part of the case band 22, there is formed an annular gasket accommodation groove 27 having continued in the circumferential direction. The gasket accommodation groove 27 is opened over a back face 22*b* of the case band 22 and a back side end part inner periphery face of the case band. An annular seal gasket 28 is accommodated in the gasket accommodation groove 27. The seal gasket 28 consists of the material capable of elastically deforming. A thickness of the seal gasket 28 in its free state is slightly thicker than a depth dimension of the gasket accommodation groove 27.

The case back 29 is attached to the back side end part of the case band 22 while closing a back face opening of the case band 22. By this attachment, the seal gasket 28 is pressurized in its thickness direction to thereby be elastically deformed to a compressed state, and bears the waterproofness between the case band 22 and the case back 29.

The armor cover 31 possesses a glass 32 of a circular shape for instance, and an annular edge member 35 to which this glass 32 has been fixed.

The edge member 35 has in its front side inner periphery part a glass fixation groove 35*a* continuing in the circumferential direction and, to this glass fixation groove 35*a*, there is fixed a peripheral edge part of the glass 32 through an attachment ring 33 for instance. The attachment ring 33 consists of a plastic gasket capable of elastically deforming, and is fixed to the glass fixation groove 35*a*. By pressing-in the glass 32 into an inside of the attachment ring 33, the glass 32 is fixed to the glass fixation groove 35*a* by utilizing the interference obtained by elastically deforming the attachment ring 33. It is also possible to fix the glass 32 fitted to the edge member 35 by using the adhesive without using the attachment ring 33 like this.

In an inner periphery part of the edge member 35, there are provided a fit part 36 and a dial cover site 37 while monolithically protruding in a back side direction.

The fit part 36 forms a tubular shape having continued in the circumferential direction of the edge member 35. The fit part 36 is a site fitted to the fit hole 24. A protrusion height (in other words, a dimension of the fit part 36 along the thickness direction of the wristwatch 11) of this fit part 36 is set approximately the same as a thickness (in other words, a dimension of the inner periphery protrusion part 23 along the thickness direction of the wristwatch 11) of the inner periphery convex part 23.

The dial cover site 37 is protruded to a front side, in other words, a glass 32 side and a case band inside, than a back face 36*a* (refer to FIG. 4 and FIG. 5) of the fit part 36. This dial cover site 37 specifies an inner diameter E (refer to FIG. 4) of the edge member 35.

The edge member 35 has a case band cover part 35*b*. The case band cover part 35*b* is a site covering the front face 22*a* of the case band 22 with a back face of the case band cover part being contacted with the front face 22*a*. This case band cover part 35*b* specifies an outer diameter F (refer to FIG. 4) of the edge member 35. Incidentally, although the case band cover part 35*b* in the example shown in the drawing is made a shape having jutted out than an outside face of the case band 22, it may not jut out, and its outer periphery face shape can be arbitrarily designed.

Figure 2:
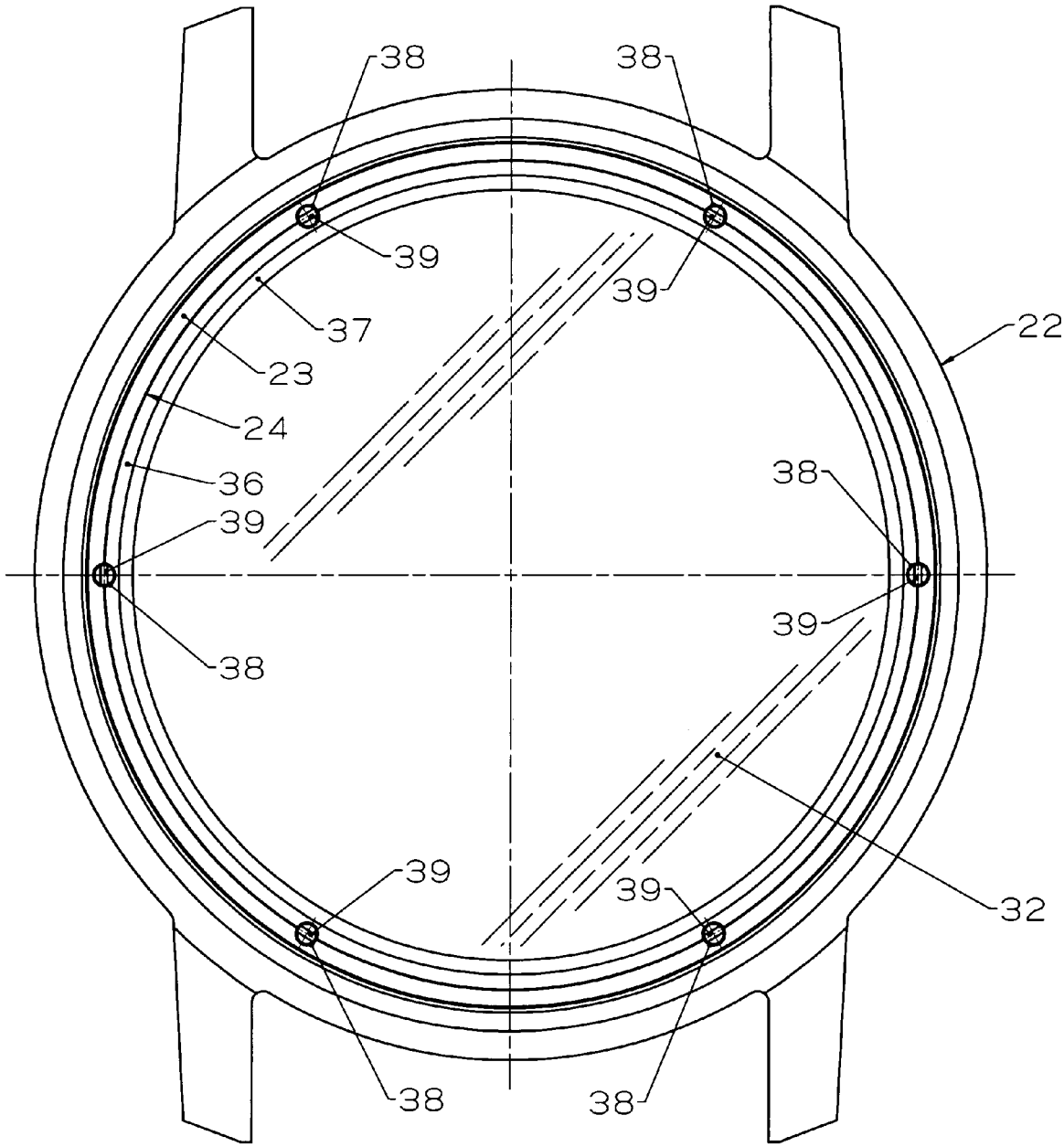
FIG. 2 is a back view showing a timepiece armor assembly of the wristwatch in FIG. 1 under a state in which its case back has been removed.

Over the inner periphery convex part 23 of the case band 22 and the fit part 36 of the edge member 35, there are provided plural threaded holes 38 opening to back faces of them. As shown in FIG. 2, these threaded holes 38 are provided in the same interval along the circumferential direction. Each threaded hole 38 is provided by being tapped from back sides of the inner periphery convex part 23 and the fit part 36 under a state in which the edge member 35 has been fitted to the fit hole 24.

Therefore, as shown in FIG. 5, it is formed with a half threaded hole portion 38*a* opening to an inner periphery face of the inner periphery convex part 23 and a half threaded hole portion 38*b* opening to an outer periphery face of the fit part 36 being united. In this case, as a desirable example, although there is made a structure in which the threaded hole portion 38*a* and the threaded hole portion 38*b* are made the same size and the threaded hole 38 has been bisected by joint faces of the inner periphery convex part 23 and the fit part 36, it is also possible to form one of the threaded hole portion 38*a* and the threaded hole portion 38*b* largely than the other by deviating the threaded hole 38 to a case band inside or a case band outside.

The threaded hole part 38*a* having been formed in the inner periphery convex part 23 is positioned in a back side of the gasket accommodation groove 25. By this, the threaded hole part 38*a* having formed a half of the threaded hole 38 is positioned in a projected region of the seal gasket 28 when the seal gasket 28 has been seen in a back side direction.

The case band 22 and the edge member 35 are connected by a connection member 39 having been screwed to each of the respective threaded holes 38. The connection member 39 is like a threaded axle, and screwed from back face sides of the inner periphery convex part 23 and the fit part 36 toward a glass 32 side. By rotating the connection member 39 in a direction reverse to this screwing, it is possible to detach the connection member 39. In order to make such screwing and detachment possible, the connection member 39 has a slitting groove 39*a* for instance as a tool engagement part.

Assembly procedures of the above wristwatch 11 are as follows. First, after the seal gasket 26 has been fitted to the gasket accommodation groove 25 of the case band 22, the armor cover 31 having been already assembled is prepared, and the fit part 36 of the edge member 35 is fitted to the fit hole 24 of the case band 22 and the case band cover part 35*b* of the edge member 35 is covered to the front face 22*a* of the case band 22.

Next, the threaded hole 38 is formed by correctly coinciding the corresponding threaded hole portions 38*a*, 38*b*, and the seal gasket 26 is retained in its compresses state by causing the back face of the case band cover part 35*b* to contact with the front face 22*a* of the case band 22. Under this state, by respectively screwing the connection members 39 to the respective threaded holes 38 to thereby connect the inner periphery convex part 23 and the fit part 36, the edge member 35 of the armor cover 31 is coupled to the case band 22.

In this case, notwithstanding the screwing of the connection member 39, a force following upon this screwing is not exerted on the seal gasket 26. However, since the seal gasket 26 is already under its compressed state while being already nipped between the case band 22 and the edge member 35, the waterproofness between the case band 22 and the edge member 35 can be made. Moreover, since the elastic repulsion force of the seal gasket 26 which is under its compressed state acts toward the facade side in a direction separating from the case band 22 in regard to the edge member 35 and, by the pre-load due to it, the mesh interstice between the threaded hole 38 and the connection member 39 is vanished, the connection member 39 can be retained so as not to loosen carelessly.

After this, the timepiece movement 14 having been supported to the casing ring 13 is incorporated into the inside of the case band 22 while being passed through a back face opening of the case band 22, thereby fixing the casing ring 13 to the case band 22. By this, the peripheral front face of the dial 16 of the timepiece movement 14 is covered by the dial cover site 37 of the edge member 35.

Subsequently, after the seal gasket 28 has been fitted to the gasket accommodation groove 27 of the case band 22, the case back 29 is coupled to the case band 22 while closing the back face opening of the case band 22. By this, since the seal gasket 28 is nipped in its compressed state by the case back 29 and the case band 22, the waterproofness between the case band 22 and the case back 29 can be made.

By the above, the assembly of the wristwatch 11 is completed. Further, in order to disassemble the wristwatch 11 in a case performing a single-piece exchange of the seal gasket 26, or the like, there suffices if the procedures are performed in an order reverse to those of the above assembly. On that occasion, the connection member 39 is detached from the threaded hole 38 by the fact that it is rotation-operated in a direction disengaging its screwing, so that the connection between the case band 22 and the edge member 35 is released.

A state in which the wristwatch 11 has been assembled is shown in FIG. 3 and FIG. 4. Under this state, one part of each of the respective connection members 39 having connected the case band 22 and the edge member 35 is included in the projected region of the seal gasket 26 to the back side. By this, the fact becomes null that all of the threaded holes 38 are provided in the fit part 36. Following upon it, since it becomes unnecessary to cause a dimension for disposing the connection member 39 while being deviated to an inside of the seal gasket 26 to ensure in the edge member 35, it is possible to narrow a dimension from the dial cover site 37 specifying an inner diameter of the edge member 35 and the parting dimension E of the dial 16 to an outer diameter of the edge member 35, in other words, the width of the edge member 35, which has been shown by a sign T in FIG. 4.

In detail, the width T is a value in which dimensions A-D of the respective parts of the edge member 35 along the radial direction of the wristwatch 11 have been totaled. The dimension A indicates a dimension of the dial cover site 37, the dimension B a dimension of a site from an inner periphery of the fit part 36 to a center line of the threaded hole 38, the dimension C a dimension from the center line of the threaded hole 38 to a site having contacted with the seal gasket 26, and the dimension D a dimension of a site from an outer periphery of the seal gasket 26 to an outer periphery of the edge member 35. Sizes of these dimensions A-D correspond respectively to the dimensions A-D in FIG. 7 having shown the wristwatch concerned with the prior art.

Figure 7:
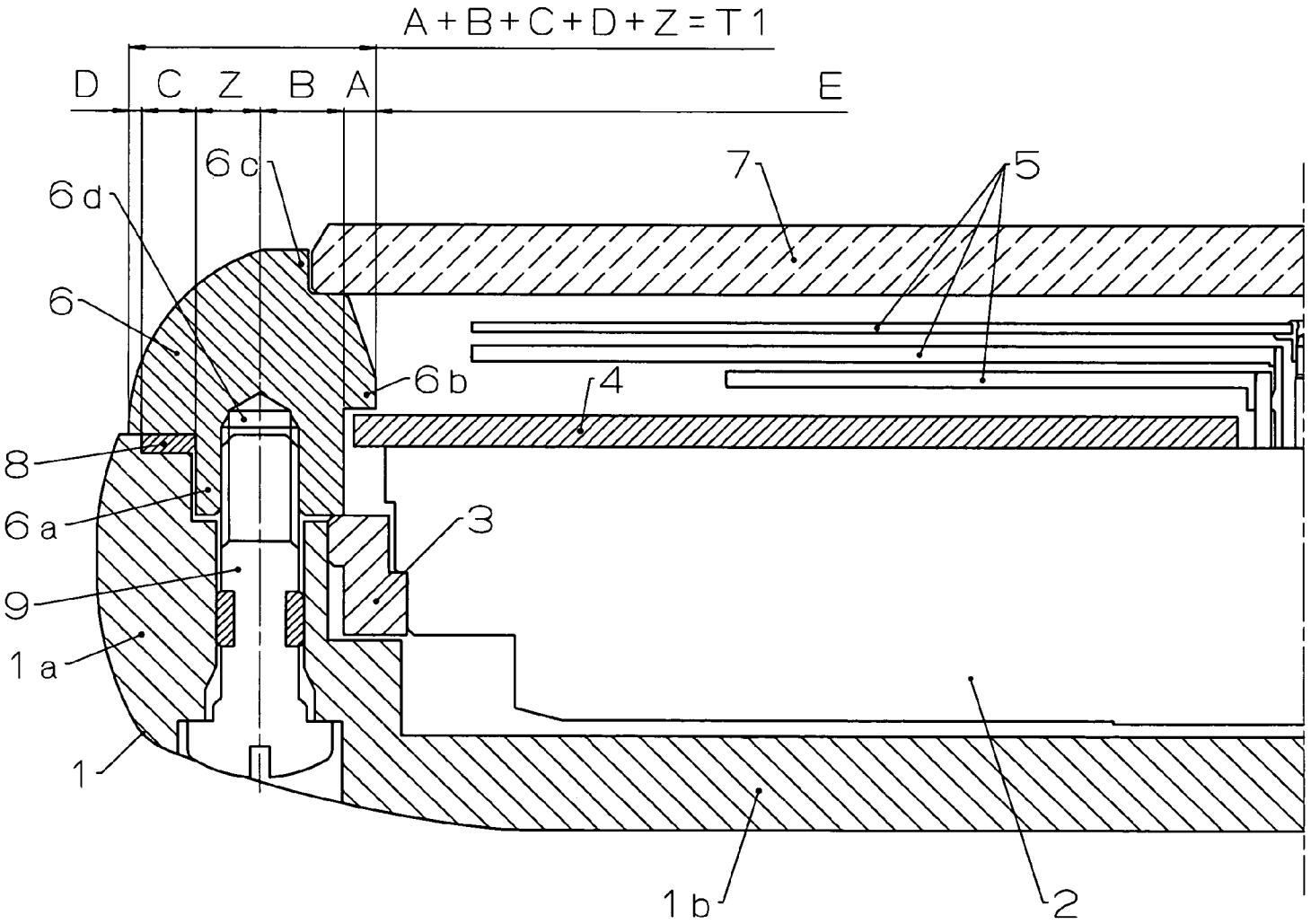
FIG. 7 PRIOR ART
FIG. 7 is a sectional view showing one part of a wristwatch concerned with a prior art.

By the fact that the threaded hole 38 is provided over the fit part 36 and the inner periphery convex part 23, there is made a constitution in which a portion corresponding to the dimension Z in FIG. 7 has been lapped to the seal gasket 26 with the wristwatch 11 being seen form a facade. Therefore, the fact becomes null that the above dimension Z reflects to the width T of the edge member 35, so that edge member 35 can be reduced in its width correspondingly. And, the dimension C in FIG. 4 corresponds to a total dimension of the dimensions C, Z in FIG. 7 having shown the wristwatch concerned with the prior art.

Moreover, the seal gasket 26 is provided such that its inner periphery face contacts with an outer periphery face of the fit part 36, and the half threaded hole portion 38*a* having been formed in the inner periphery convex part 23 in the threaded hole 38 is positioned in the projected region (A width of this region is denoted by the above dimension C.) of this seal gasket 26 to the back side. Therefore, the edge thinning of the edge member 35 can be made by for a dimension corresponding just to dimensions of radii of the threaded hole 38 and the connection member 39. Together with this, since the catching of the connection member 39 in regard to the threaded hole portion 38*b* of the fit part 36 is ensured by a semicircle of the connection member 39, there is no fact that a retention action of the edge member 35 in regard to the case band 22 greatly decreases.

In addition to it, as mentioned already, since the inner periphery face of the seal gasket 26 is provided so as to contact with the outer periphery face of the fit part 36, a distance between the seal gasket 26 and the connection member 39 becomes minimum. Following upon it, by vanishing the mesh interstice between the threaded hole 38 and the connection member 39 by the pre-load due to the elastic repulsion force of the seal gasket 26, it is possible to make such that the connection member 39 does not loosen carelessly. Incidentally, in order to realize this, since the gasket accommodation groove 25 opening to an inner periphery face of the inner periphery convex part 23 has been provided in the case band 22, the gasket accommodation groove 27 can be worked easily than a groove working in a case where the gasket accommodation groove 27 is provided in the back face of the case band cover part 35*b* of the edge member 35.

Further, by the width thinning of the edge member 35, which has been already mentioned, besides the fact that a use amount of a metal material constituting the edge member 35 decreases and the wristwatch 11 can be made light in weight, there can be made the wristwatch 11 of a design which has made its visual impression simple.

That is, following upon the width thinning of the edge member 35, since an exposed site of the edge member 35, in other words, the width of the case band cover part 35*b*, i.e., a width in which the dimensions C, D have been totaled, becomes narrow, the fact is reduced that the wristwatch 11 is viewed in a sensation (volume sensation) exerting a robust, heavy impression. Additionally, since the width, in which the dimensions C, D have been totaled, that is the width from the center line of the threaded hole 38 and the connection member 39 to the outer diameter of the edge member 35 becomes narrow, if it is supposed that the outer diameter of the wristwatch 11 is the same as conventional one, a position of the dial cover site 37 is deviated in an outer diameter direction. Therefore, following upon the fact that the parting diameter E is ensured large and a display part of the dial 16 can be enlarged, a visibility of the display is raised. Reversely to this, if it is supposed that the parting diameter E is the same as conventional one, the edge member 35 can be made a small diameter by a dimension having corresponded to the above width thinning, so that it is possible to reduce a visual volume sensation of the wristwatch 11.

Further, as mentioned already, since the case band 22 and the edge member 35 have been connected from their back sides by the threaded-axle-like connection member 39, there is no fear that a stress following upon this connection extends to a circumferential portion of the glass fixation groove 35*a* of the edge member 35 and thus this circumferential portion is deformed. Therefore, even if a peripheral edge part of the glass 32 is fixed to the glass fixation groove 35*a* by the adhesive, there can be made such that no exfoliation of the glass 32 is induced following upon the connection between the case band 22 and the edge member 35. Similarly, as having been exemplified in the drawing, even if it is a constitution in which the glass 32 has been fixed to glass fixation groove 35*a* by using the attachment ring 33, since there is no fear that this glass fixation portion deforms following upon the connection between the case band 22 and the edge member 35, a reliability of the fixation of the glass 32 can be ensured. Accordingly, like the above, since it is possible to fix the glass 32 to the edge member 35 by utilizing the bonding fixation or the interference of the attachment ring 33, the selectivity of the fixation means of the glass 32 in regard to the edge member 35 can be obtained.

Incidentally, in a case where, instead of using the attachment ring 33, the glass 32 has been fixed to the glass fixation groove 35*a* by the adhesive, there is not restricted to the fact that the edge member 35 or the like is a circular shape, and there can be constituted the wristwatch of various annular shapes demanded in the design. Additionally, in the case where the glass 32 has been fixed to the glass fixation groove 35*a* by the adhesive, there is no fact that the edge member 35 becomes thick as a result of deepening the glass fixation groove 35*a* in order to ensure the retention of the glass 32 like the case where the attachment ring 33 has been used. Together with this, there is also no fact that the width of the edge member 35 increases as a result of the fact, in order to prevent a deformation around the glass fixation groove 35*a*, which follows upon a pressing-in of the glass 32, a wall thickness of that portion is thickened.

Figure 6:
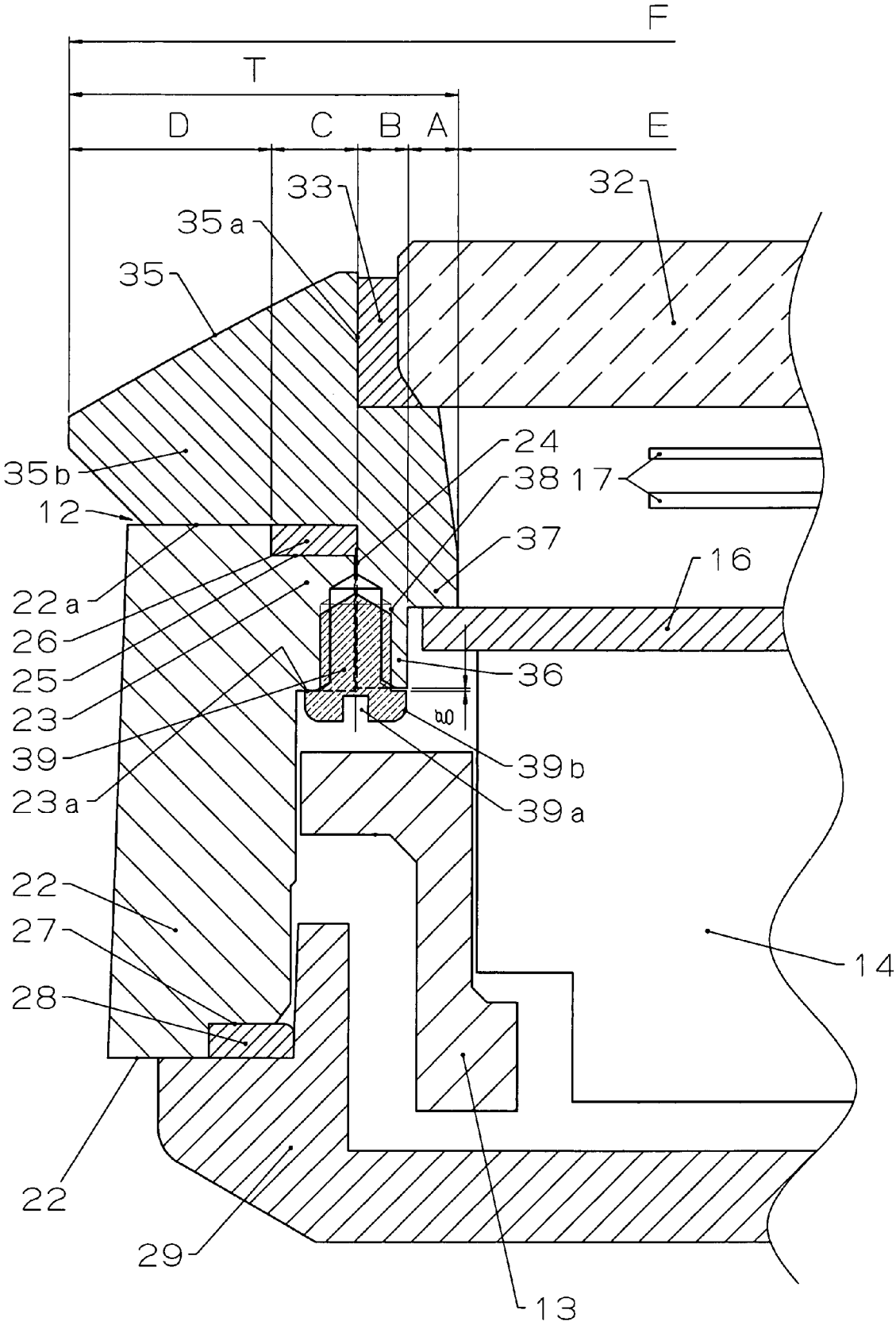
FIG. 6 is a sectional view showing one part of a wristwatch concerned with a second embodiment of the present invention.

FIG. 6 shows a second embodiment of the present invention. In this second embodiment, since matters other than those explained below are the same as the first embodiment while including matters not shown in FIG. 6, about the same constitution as the first embodiment, there is applied the same reference numeral, and its explanation is omitted.

In the second embodiment, a protrusion height (in other words, a dimension of the fit part 36 along the thickness direction of the wristwatch 11) of the fit part 36 is set shorter than a thickness (in other words, a dimension of the inner periphery convex part 23 along the thickness direction of the wristwatch 11) of the inner periphery convex part 23. Together with this, in the connection member 39, there is provided a head part 39*b* having the slitting groove 39*a*. Under a state in which the connection member 39 has been suitably screwed to the threaded hole 38, there is made such that the head part 39*b* contacts with at least a back face 23*a* of the inner periphery convex part 23 between the back face 23*a* of the inner periphery convex part 23 and the back face 36*a* (refer to FIG. 5) of the fit part 36.

Since matters other than those explained above are the same as the first embodiment, the second embodiment obtains actions similar to those explained in the first embodiment, and can solve the problems of the present invention similarly to the first embodiment. If mentioned briefly, since there is no necessity to provide, in the fit part 36 of the edge member 35, all of the threaded holes 38 to which the threaded-axle-like connection member 39 connecting the case band 22 and the edge member 35 is screwed, the edge thinning of the edge member 35 can be promoted and the connection member 39 can connect and detach the case band 22 and the edge member 35 from their back sides, so that it is possible to provide the wristwatch 11 in which there are not impaired the exchangeability of the seal gasket 26 between the case band 22 and the edge member 35 to which the glass 32 has been fixed, and the selectivity of the fixation means of the glass 32 in regard to the edge member 35.

Moreover, the wristwatch 11 of the second embodiment is advantageous in the following points.

That is, on the occasion of coupling the edge member 35 to the case band 22 by the procedures having been explained in the first embodiment, if the connection member 39 is screwed to the threaded hole 38, in its final stage, the head part 39*b* collides against the back face of the inner periphery convex part 23. At this time point, as shown in FIG. 6, in compliance with a difference in height dimension between the inner periphery convex part 23 and the fit part 36, or the like, the back face 36*a* of the fit part 36 deviates to a front side (glass 32 side) in regard to the back face 23*a* of the inner periphery convex part 23, so that a gap g is formed between the back face 36*a* of the fit part 36 and the head part 39*b*.

And, by the fact that the screwing of the connection member 39 is subsequently advanced, since there becomes such that the gap g is decreased or vanished, following upon the fact that the case band 22 and the edge member 35 are connected, the edge member 35 is brought closer to a back side in compliance with a dimension corresponding to the gap g. Therefore, the seal gasket 26 having been disposed between the edge member 35 and the case band 22 is nipped more strongly, so that it is possible to more certainly bring about its waterproof performance.

Further, since the connection member 39 has the head part 39 *b* corresponding to a screw head, the slitting groove 39*a* with which the tool for rotation-operating the connection member 39 is engaged can be made large. Therefore, the rotation operation of the connection member 39 becomes easy to perform.

What is claimed is:

1. A timepiece comprising:

an armor case which possesses a case band protruding to a case band inside and having an inner periphery convex part having therein a fit hole and continuing in a circumferential direction, and a timepiece movement with a dial disposed in the case band, an annular edge member which is overlapped to a front side of the case band and having a tubular fit part fitted to the fit hole and a dial cover site for covering a peripheral part front face of the dial in the case band inside and the fit part, and a glass fixed to the annular edge member, an annular seal gasket comprising an elastic material, provided outside of the fit hole and nipped between the edge member and the case band, plural threaded holes, each of which is formed partially in the inner periphery convex part and partially in the fit part while being positioned in a back side of the gasket, and in which a portion of each of the threaded holes is located in a projected region of the seal gasket to the back side, and a threaded connection member detachably screwed to each of the threaded holes from back sides of the inner periphery convex part and the fit part to thereby retain the edge member to the case band.

2. A timepiece according to claim 1, wherein an inner periphery face of the seal gasket is provided so as to contact with an outer periphery face of the fit part, and a half threaded hole portion is formed in the inner periphery convex part within the threaded hole and is included in the projected region of the seal gasket to the back side.

3. A timepiece according to claim 2, wherein a gasket accommodation groove opening is provided over a front face of the case band, with which the edge member contacts, and an inner periphery face of the Inner periphery convex part is formed in the case band, and the seal gasket is attached to the accommodation groove.

4. A timepiece according to claim 1, wherein a length of the fit part along a thickness direction of the timepiece Is shorter than a length of the inner periphery convex part along the thickness direction of the timepiece, and a head part contacting with a back face of the inner periphery convex part is provided in the connection member.

5. A timepiece according to claim 2, wherein a length of the fit part along a thickness direction of the timepiece is shorter than a length of the inner periphery convex part along the thickness direction of the timepiece, and a head part contacting with a back face of the inner periphery convex part is provided in the connection member.

6. A timepiece according to claim 3, wherein a length of the fit part along a thickness direction of the timepiece is shorter than a length of the inner periphery convex part along the thickness direction of the timepiece, and a head part contacting with a back face of the inner periphery convex part is provided in the connection member.

* * * * *